United States Patent [19]

Vork

[11] Patent Number: 4,876,951

[45] Date of Patent: Oct. 31, 1989

[54] AIR REGISTER HANDLE ARRANGEMENT

[75] Inventor: Donald J. Vork, Holland, Mich.

[73] Assignee: Hart & Cooley, Inc., Holland, Mich.

[21] Appl. No.: 130,622

[22] Filed: Dec. 9, 1987

[51] Int. Cl.[4] ..... F24F 13/15

[52] U.S. Cl. ..... 98/107; 98/110

[58] Field of Search ..... 74/57, 107; 98/41.1, 98/107, 110, 121.2; 251/229, 251, 252

[56] References Cited

U.S. PATENT DOCUMENTS

| | | | |
|---|---|---|---|
| 210,015 | 11/1878 | Cruse . | |
| 279,155 | 6/1883 | Hayes . | |
| 629,680 | 7/1899 | Hamalian . | |
| 1,310,870 | 7/1919 | Mapson . | |
| 1,413,469 | 4/1922 | Gentrup . | |
| 2,209,384 | 7/1940 | Brown . | |
| 2,485,263 | 10/1949 | Digby . | |
| 2,583,230 | 1/1952 | Peters . | |
| 2,761,371 | 9/1956 | Parrish | 98/110 |
| 3,500,739 | 3/1970 | Dry | 98/121.2 X |
| 3,720,154 | 3/1973 | Biggi | 98/110 |
| 3,943,784 | 3/1976 | Supper | 98/41.1 X |

FOREIGN PATENT DOCUMENTS

| | | | |
|---|---|---|---|
| 129577 | 10/1948 | Australia | 49/88 |
| 518770 | 4/1953 | Belgium | 49/88 |
| 1355455 | 12/1964 | France | 49/88 |
| 88802 | 2/1957 | Norway | 98/110 |
| 260805 | 8/1949 | Sweden | 98/110 |
| 139365 | 3/1953 | Sweden | 49/88 |
| 349 | of 1899 | United Kingdom | 98/110 |
| 1326204 | 8/1973 | United Kingdom | 98/110 |

*Primary Examiner*—Harold Joyce

*Attorney, Agent, or Firm*—Varnum, Riddering, Schmidt & Howlett

[57] ABSTRACT

An air register handle (10) for mounting in an air register arrangement (12) to adjust the volume and/or direction of air flow through the register (12). The handle (10) includes a bracket (22) adapted to extend forwardly of a front plate (40) of the register (12). The bracket (22) is integral with a straight portion (20) adapted to extend rearwardly through a slot (44) on one side of the front plate (40). Handle tabs (24) extend from the straight portion (20) in a plane skewed relative to the plane of the straight portion (20). An arcuate flat portion (26) located rearwardly of the straight portion (20) comprises two arcuate arms (29) forming a slot (28) opening toward the rear of the handle (10). The slot (28) is adapted to receive a pintle (56) connected to a link (54) which interconnects a set of adjustable louvers (52).

19 Claims, 2 Drawing Sheets

AIR REGISTER HANDLE ARRANGEMENT

DESCRIPTION

1. Technical Field

The invention relates broadly to registers of the type used in air conditioning, ventilation, and heating systems; and, more particularly, relates to handle apparatus for adjusting dampers or like adjustable elements so as to regulate the air flow.

2. Background Art

Heating, ventilation, air conditioning and similar types of systems employing air flow for controlling the environment of enclosed or partially enclosed spatial areas typically comprise one or more apertures opening into the spatial area. The environmental control is achieved through the passage into or out of these apertures. These apertures may be located in a wall, ceiling or floor, and provide the openings for ducts or similar apparatus through which air flow is directed. It is relatively common to install air "registers" at these ducted openings to direct and otherwise control the flow of air into the spatial areas.

Numerous types of air registers are well known and commercially available. One aspect common to many of the registers which allow for directional and/or volume control of air flow is the use of movable structures which permit adjustment of the "open" cross-sectional area of the aperture, or otherwise permit directional deflection of air flow. For example, it is known to use sets of adjustable louvers or dampers to adjust the open cross-sectional area or air flow deflection, thereby controlling the volume and direction of air flow.

For purposes of actual adjustment of these louvers or dampers, various types of mechanisms have been developed. For example, some of these known adjustment mechanisms are "automatic" and comprise means for louver or damper adjustment in response to various environment mental conditions, such as the temperature of the spatial area to be controlled. Other relatively more common arrangements include manually operable mechanisms coupled to the adjustable louvers or dampers for purposes of volume and directional air flow adjustment. A number of manually operable mechanisms are commercially available. Several of these manual mechanisms include separately adjustable devices, with each device interconnected with a different one of a series of adjustable louvers. A number of these known mechanisms include levers or handles mounted to the sides of the air registers, with the levers or handles having a protrusion extending through a cover of the register. These levers or handles are often of relatively large thicknesses, thereby requiring correspondingly large openings to appropriately mount the register handles.

Other types of manually operable mechanisms having improved structural configurations and louver interconnection arrangements have also been developed. For example, Parrish, U.S. Pat. No. 2,761,371 issued Sept. 4, 1956 discloses an air register having a wall plate and a rearwardly projecting rectangular frame. The frame includes an outer metal frame and an inner metal frame. End plates of the inner frame have inwardly stamped bosses positioned in a vertically disposed row. Top and bottom plates of the inner frame also have inwardly stamped bosses, with the bosses disposed in lengthwise rows along the front edges of the plates.

The inwardly stamped bosses of the inner frame frictionally mount pintles of a rear set of horizontal louvers. Correspondingly, the inwardly stamped bosses of the top and bottom plates of the inner frame frictionally mount a second set of pintles of a front set of vertically disposed louvers. Both the front vertical louvers and the rear vertical louvers are independently adjustable. These louvers are described by Parrish as being maintained stationary merely by means of the frictional engagement with the mounting bosses.

The louvers are adjustable by means of a key having a notch at one end, with the key adapted to be inserted through the center of the wall plate. The notch is positioned so that it individually engages each of the horizontal louvers, or each of the vertical louvers so as to adjust the same.

The Parrish arrangement also includes what is characterized as a damper provided behind the rear horizontal louvers. The damper includes other pivotable horizontal louvers, with vertical links pivotably connecting these louvers for movement in unison. These louvers include flanges connected by pivot axes to end plates of the outer frame. The links are also connected at a set of pivot axes to the louver flanges.

Parrish further describes a vertically "swingable" adjusting arm. The adjusting arm includes a slot engaging a pin at a specific pivot location so as to provide connection to one of the links. The arm is also positioned on one of the end plates of the outer frame, and includes a pivotable mounting between this end plate and a retaining plate. The arm includes a bearing opening in its front portion, with the adjacent end plate having a boss received within the opening. This boss includes a central opening, and the retaining plate includes an inwardly stamped boss received within the opening. With this arrangement, the arm is characterized as being frictionally held in any position to which it may be rotated when adjusting the damper.

For purposes of rotating the arm, the wall plate includes a vertically disposed slot through which the key can be inserted. The key includes one end having a lug engagable with a notch located at the front portion of the arm. Rotation of the arm by means of the key correspondingly moves the vertical link through the engagement of the arm. This movement, through the pivoting action of the flanges, correspondingly adjusts the position of the louvers in unison.

The lever arrangements disclosed in Parrish and other known manually operable mechanisms for adjustment of louver or dampers in air registers commonly use levers or other devices protruding through the face of the register which directly pivot about a stationary fulcrum. With this type of pivot arrangement, a substantial portion of the level will necessarily protrude from the face of the register at certain adjustment configurations, if the louvers or dampers are to be adjusted throughout a relatively complete range of motion with a minimum of manual effort. Such protrusions can be a problem with respect to appearance. In addition, such protrusions can actually be somewhat dangerous, especially if the register is mounted in a floor or wall.

Other problems associated with air register operating mechanisms also exist in a number of the known devices. For example, when a manually operable lever is removable, such as in arrangements as disclosed in the Parrish patent, the mechanisms can be easily lost. Of potentially greater importance, a number of the known air register lever or handle mechanisms include a relatively complex assembly configuration. These configurations often have a substantial number of moving parts, with numerous corresponding interconnections. Accordingly, such complex configurations are typically relatively more difficult and expensive to manufacture and assemble. In addition to the problems associated with original manufacture and assembly, such configurations, with the numerous linkage interconnections, will tend to "gum up," especially if utilized in an industrial or similar environment with severe environmental conditions, such as the existence of dust or like contaminants.

Still further, these complex mechanisms can be relatively difficult to maintain. For example, if a manually operable lever mechanism breaks down after the air register has been installed, many of the known mechanisms are relatively difficult to replace. Several of these mechanisms require either specialized tools or a number of tools for purposes of replacement. As a result of the relative difficulty of replacement, the tendency for linkage connection points to gum up and the substantial number of parts comprising many of these mechanisms, the cost of maintenance can be relatively high.

In addition to the foregoing, a number of known mechanisms are composed of heat conductive materials. Accordingly, many of these mechanisms tend to expand or contract with the temperature of the air passing through the register. Consequently, these mechanisms will tend to bind and become more difficult to operate. In fact, it is also possible for such mechanisms to become sufficiently hot or cold so that they cannot be comfortably manually operated. Finally, a number of these mechanisms are also typically constructed of relatively corrosive materials. Accordingly, these mechanisms tend to wear relatively rapidly, especially if the air registers are employed in severe environments.

SUMMARY OF THE INVENTION

In accordance with the invention, an air register handle is adapted to be mounted in an air register arrangement for purposes of regulating air flow through the air register arrangement into a spatial environment. The air register arrangement can include a frontal face through which air can flow into or from the spatial environment. A slot arrangement is located in and extends through the frontal face. The slot arrangement is adapted to receive the air register handle so that a portion of the handle protrudes forwardly of the frontal face. An adjustable mechanism is mounted rearwardly of the frontal face so that movement of the adjustable mechanism regulates volume and/or direction of air flow through the frontal face.

The air register handle can include a first portion adapted to extend through the slot arrangement. A bracket is connected to the first portion and adapted to protrude forwardly of the frontal face to provide means for a user to manually grasp and operate the air register handle. A tab arrangement is interconnected with the first portion and includes a planar configuration skewed relative to the planar configuration of the first portion. In this manner, substantial movement of the handle forwardly toward the frontal face is prevented when the handle is mounted in the air register arrangement. A coupling configuration is coupled to the adjustable mechanism to exert forces on the adjustable mechanism in response to manual forces exerted on the bracket by the user when the handle is mounted in the air register arrangement.

The coupling configuration includes a slot opening toward an end opposing an end of the first portion to which the bracket is connected. The slot can be of an arcuate shape, and can also curve upwardly from the slot opening toward the first portion. Still further, the slot can be formed by a pair of rearwardly extending and substantially coplanar arms having a fork-shaped configuration.

The adjustable mechanism can include an interconnection configuration for interconnecting the adjustable mechanism to the coupling arrangement when the handle is mounted in the air register. With this configuration, the slot is adapted to receive the interconnection arrangement so that the interconnection arrangement traverses along a path of the slot in response to manual forces exerted on the bracket by the user. The interconnection arrangement can include a pintle engaging the slot when the handle is mounted in the air register.

More specifically, the adjustable mechanism can include a louver arrangement positioned rearwardly of the frontal face and adjustable so as to regulate volume and/or direction of air flow through the face. A connecting arrangement can interconnect individual ones of the louver mechanism so as to provide operation of the individual ones in unison. A pintle arrangement can be coupled to the connecting arrangement, and the slot can be adapted to receive the pintle arrangement when the handle is mounted in the air register.

The tab arrangement can include a pair of coplanar tabs having a resiliency sufficient to as to allow the tab pair to bend toward the plane of the first portion when forces are exerted on the handle so as to cause the handle to be moved through the air register slot when the handle is installed in the air register. The tab arrangement can include at least one tab adapted to abut a surface of the air register so as to provide a frictional engagement therewith. More specifically, the tab arrangement can include a first resilient tab located adjacent a first edge of the first portion, and a second resilient tab substantially coplanar with the first tab and positioned adjacent a second edge of the first portion. With this configuration, the second edge is substantially parallel to the first edge.

The slot arrangement of the air register can include a vertically disposed and elongated slot located at one side of the frontal face. The bracket can be integral with the first portion and of a size sufficient so as to prevent the handle from being pushed rearwardly of the frontal face when the handle is mounted in the air register.

The first portion can include a straight flat portion adapted to extend through the slot of the air register. The coupling arrangement can include an arcuate flat portion coplanar and integral with the first portion. The arcuate flat portion can be of a fork-shaped configuration having a pair of substantially parallel and arcuate arms forming a slot at the end of the handle.

BRIEF DESCRIPTION OF THE DRAWINGS

The invention will now be described with reference to the drawings, in which.

DETAILED DESCRIPTION

The principles of the invention are disclosed, by way of example, in an air register arrangement 12 as shown in FIGS. 1 through 7 as described in detail herein. The air register arrangement 12 includes a handle 10 (FIGS. 2-7) utilized to adjust the volume and direction of air flow through a heating, air conditioning of similar type of ventilation system duct (not shown). The air register handle 10 is constructed in a manner so as to have a relatively "low" profile, and an aesthetically pleasing appearance. In addition, the interconnection of the air register handle 10 to other structural components of the register 12 is such that a relatively small number of linkage connection points are required, thereby reducing the potential of a large number of connection points being "gummed up."

Still further, the operation of the air register handle 10 with the other components of the register arrangement 12 comprises a relatively smooth acting mechanism. The interconnection arrangement of the handle 10 with the other components of the register 12 also provides for a relatively small number of parts, and relative ease of replacement since the connection arrangement utilizes a "snap-in" configuration, with no requirement of tools for purposes of replacement. These and other advantages of the air register handle 10 with the register arrangement 12 in accordance with the invention will be more fully apparent with the understanding of the details of the invention as set forth in subsequent paragraphs herein.

Figure 1:
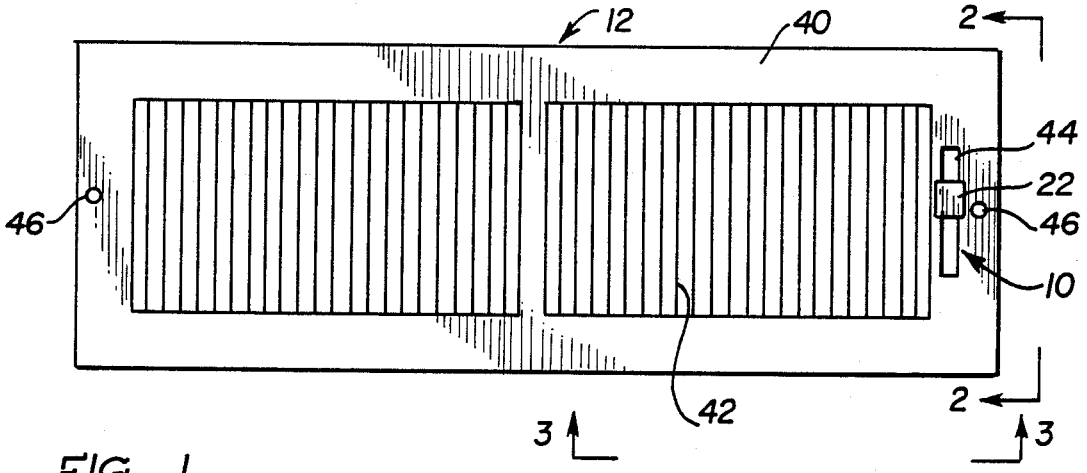
FIG. 1 is an elevation view of one illustrative embodiment of an air register with a handle arrangement in accordance with the invention.
Figure 3:
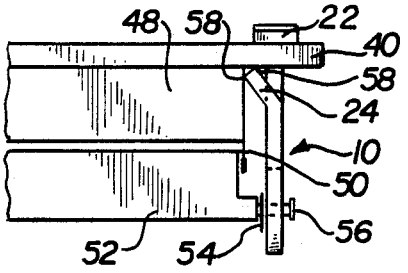
FIG. 3 is a sectional underside view of the air register along section lines 3—3 of FIG. 1.

The air register 12 is in substantial part of a relatively conventional design and adapted for use in a floor, wall, ceiling, or other similar area for providing air flow into an enclosed or partially enclosed spatial area from heating, air conditioning or similar types of ventilation systems, thereby providing environmental control. As shown in FIGS. 1 and 3, the register 12 comprises a front plate 40 having vertically disposed fixed "flutes" or louvers 42 which form fixedposition ventilation apertures. The front plate 40 also includes a vertically disposed elongated slot 44 through which the air register handle 10 protrudes in part for purposes of manual operation.

As will be described in greater detail subsequently herein, the air register handle 10 includes a rectangular bracket 22 having a relatively large cross section as shown in FIGS. 1, 3, 4 and 5. This relatively large cross section of bracket 22 prevents the handle 10 from passing completely through the elongated slot 44 in a direction toward the air flow duct.

Details of other elements of the specific structural configuration of the air register handle 10 in accordance with the invention will be described in subsequent paragraphs herein. The register 12 can be secured to the floor, wall or ceiling, by the use of connecting means such as screws or the like (not shown) received through the mounting holes 46.

Referring to FIGS. 2A, 2B, 2C and 3, the air register arrangement 12 includes a rectangular frame 48 which projects rearwardly from the front plate 40, with a relatively smaller cross section with respect to the front plate 40. The frame 48 can be secured to the front plate 40 by any of several suitable connecting arrangements, such as a weldment or the like. Frame tabs 50 further extend rearwardly from two opposing sides of the rectangular frame 48, and parallel to the elongated slot 44. The frame tabs 50 each includes an aperture 59. As shown further in FIGS. 2A, 2B, 2C, 3 and 6, a series of parallel and adjustable ventilation louvers 52 are mounted rearwardly of the rectangular frame 48. Each of the adjustable louvers 52 includes a transversely mounted axis located adjacent and parallel to one edge of the louver 52, and having its two opposing terminating ends pivotably engaged with a corresponding set of the apertures 59 of the frame tabs 50.

A second transverse axis extends adjacent and parallel to an opposing edge of each of the adjustable louvers 52. One terminating end of each second axis is pivotably secured to one of a series of vertically disposed apertures 60 in a connecting link 54 which acts to interconnect each of the adjustable louvers 52. In this manner, forces exerted on the connecting link will cause simultaneous operation of the ventilation louvers. Although not shown in detail, the pivotable interconnections of the transversely mounted axes with the apertures 59 and 60 can be achieved by means of appropriately sized bosses, extending tabs or similar structures which extend slightly laterally outward from the sides of the louvers 52. However, it is apparent that numerous other types of pivotable interconnection arrangements can be utilized.

Figure 4:
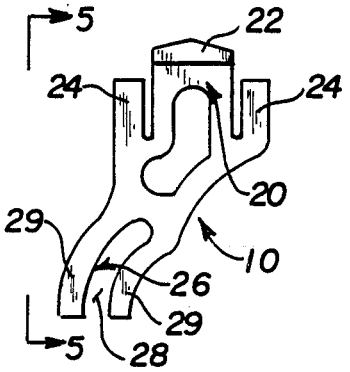
FIG. 4 is an elevation of the air register handle as embodied in FIGS. 1-3.
Figure 5:
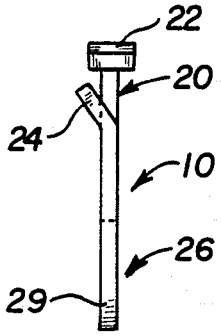
FIG. 5 is a view of the air register handle taken along lines 5—5 of FIG. 4.

Referring specifically to FIGS. 4 and 5, an illustrative embodiment of the structural configuration of the air register handle 10 in accordance with the invention comprises a straight flat portion 20 and an arcuate flat portion 26, coplanar therewith. The rectangular bracket 22 extends perpendicularly from one end of the straight flat portion 20. Two handle tabs 24 extend from the straight flat portion 20 in a plane slightly skewed from the plane of the straight flat portion. The plane of the handle tabs 24 and the relative dimensions of the same should provide for some friction between the ends of the tabs 24 and the surfaces of plate 40 and frame 48 at friction points 58. The arcuate flat portion 26 can be characterized as having a fork-shaped configuration, whereby two essentially parallel and arcuate arms 29 form an open slot 28 at the end of the handle 10 opposing the end to which the rectangular bracket 22 is secured. The open-ended slot 28 will also have an arcuate configuration, conforming to the curve of the arms 29.

The interconnection of the air register handle 10 with the air register arrangement 12 will now be described primarily with respect to FIGS. 2A, 2B, 2C and 3. As shown therein, the air register handle 10 is disposed through the elongated slot 44 of the front plate 40, such that the rectangular bracket 22 is located outwardly from and adjacent to the front plate 40. Again, the size of the rectangular bracket 22 should be such that it prevents the air register handle 10 from being pulled completely through the elongated slot 44. At the opposing end of the register handle 10, the open-ended slot 28 engages a pintle 56 projecting laterally outward from the vertically disposed connecting link 54. The handle tabs 24 are interposed in the space between the handle portion 20 and the rectangular frame 48 such that the ends of the tabs 24 abut the intersection of the surface of one side of the rectangular frame 48 and the rear surface of the front plate 40 at friction points 58. With the handle tabs 24 located as shown, the handle 10 is prevented from forward movement outwardly of the front surface of the front plate 40.

Figure 2A:
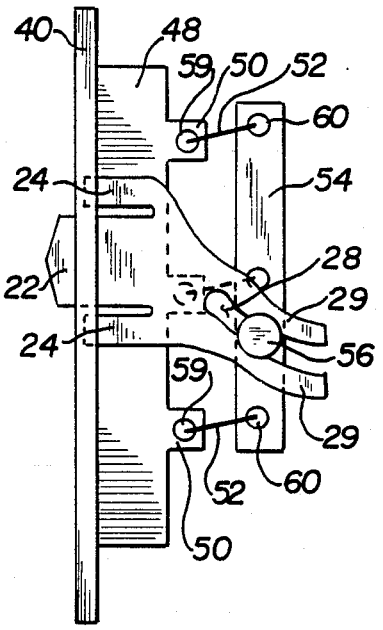
FIG 2A is a side view of the air register taken along lines 2—2 of FIG. 1 and showing the adjustable louvers of the register fully open.
Figure 2B:
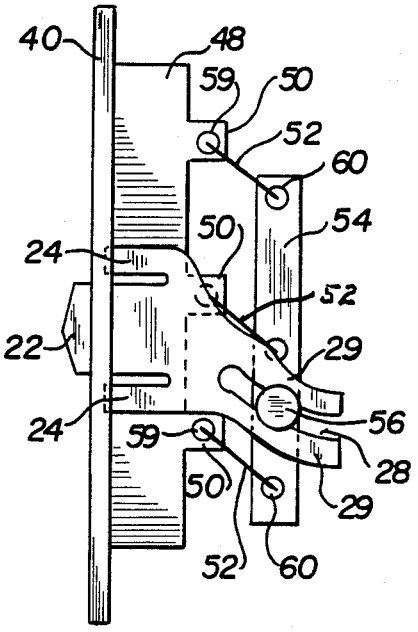
FIG. 2B is a side view of the air register taken along lines 2—2 of FIG. 1 and showing the adjustable louvers of the register partially closed.
Figure 2C:
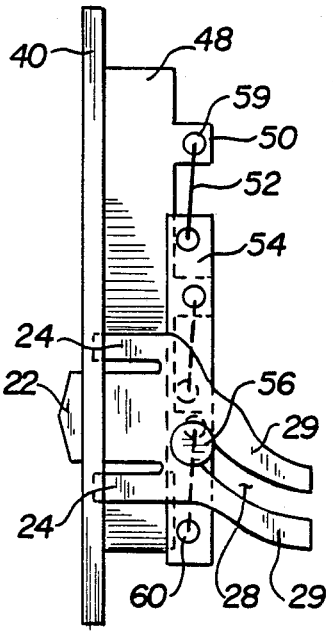
FIG. 2C is a side view of the air register taken along lines 2—2 of FIG. 1 and showing the adjustable louvers of the register fully closed.

The operation of the air register 10 in accordance with the invention will now be described primarily with respect to FIGS. 2A, 2B and 2C. To adjust the spatial configuration and angle of the adjustable louvers 52, the user operates the handle 10 by grasping the rectangular bracket 22 and exerting forces in a direction so as to manually slide the bracket 22 in a rectilinear manner along the elongated slot 44 of the front plate 40. It should also be noted that thumb pressure on the sloped surface of the bracket 22 will result in forces of an appropriate direction so as to cause the handle 10 to slide in the corresponding direction.

The force exerted in moving the handle 10 rectilinearly is somewhat opposed by the friction generated at friction points 58, and may also be opposed by friction between the rear surface of rectangular bracket 22 and the front plate 40. The curvature or slope of the handle slot 28, relative to the interconnection dimensions of the adjustable louvers 52 and their pivot centers, causes vertical forces exerted on the rectangular bracket 22 by the user to be translated to forces exerted by the connecting link 54 on the louvers. The forces exerted by the connecting link 54 cause the adjustable louvers 52 to pivot about their first and second transverse axes, thereby causing the adjustable louvers 52 to rotate between open and closed positions as shown in FIGS. 2A, 2B and 2C. The rectilinear motion of the handle 10 thus facilitates the rotational motion of the adjustable louvers 52 in a straightforward manner with no interconnecting linkages and a simplicity of motion. Furthermore, the user can leave the louvers at any degree of desired opening by simply stopping the relative motion of the handle. The handle 10 and interconnected adjustable louvers 52 maintain the desired position by means of the frictional engagement of various portions of the handle 10 with other components of the air register handle 12 as previously described. It should be emphasized that no lubrication is necessary or desired because of the necessity of maintaining the friction.

The handle 10 can be made of any suitable material that will maintain stiffness in the presence of heat, such as that emanating from a heating duct, yet at the same time maintain appropriate elastomer qualities to provide sufficient friction at the primary friction points 58. For example, the handle 10 can be constructed by an injection molding process, with a polymer containing 33% glass filled nylon. However, numerous other manufacturing processes and materials can be employed without departing from the novel concepts of the invention.

Figure 6:
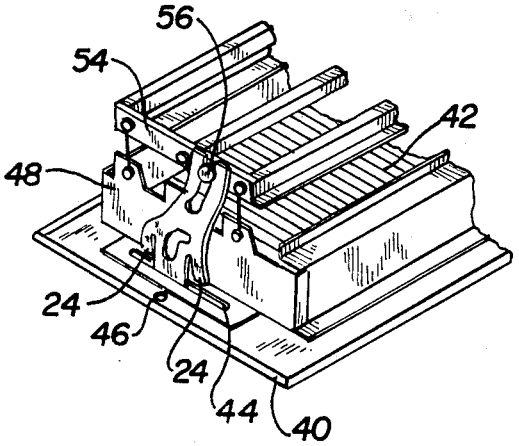
FIG. 6 is a perspective view of the embodiment of the air register and handle as shown in FIG. 1 in accordance with the invention.
Figure 7:
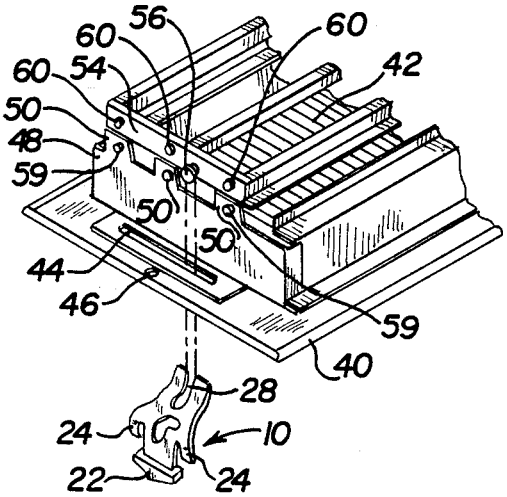
FIG. 7 is an exploded view of the air register and handle arrangement shown in FIG. 6, illustrating the installation of the air register handle.

The open slot 28 at the end of the curved flat portion 26 of the handle 10 and the relative thickness of the handle 10 with respect to the elongated slot 44 of the register 12 provides simple installation. As shown in FIG. 7, the handle 10 can be installed by pushing the flat portions of the handle through the elongated slot 44, and aligning the open slot 28 on the end of the handle with the pintle 56. A simple thrust of the handle through the slot 44 will cause the handle tabs 24 to snap into place as shown in FIG. 6, such that the handle 10 can neither be pushed nor pulled through the slot 44 and is restricted only to the rectilinear motion which adjusts the louvers 52.

It is apparent that the air register handle 10 as described above is simple in design and construction, thereby maintaining relatively low costs of manufacture, installation and maintenance. Another advantage of the invention can be seen in the low profile of the rectangular bracket 22 extending forward of the front plate 40. This configuration is aesthetically pleasing and safer, particularly in a situation where it is utilized with a floor register.

In addition to the advantages described above, it is also apparent that when the handle is constructed of nonconductive materials, the operator can much more comfortably adjust the louvers, whether from a heat duct or a cooling duct, because the handle will much more closely maintain the ambient temperature, unlike metallic and other conductive levers or handles.

In addition to the foregoing, it should also be noted that with the handle 10 in a fixed position within the air register 12, the handle 10 will not be readily removable and potentially lost. Also, it is apparent from the foregoing that the handle 10 and the interconnection of the handle 10 with the air register 12 involves a relatively small number of moving parts, with a relatively small number of corresponding interconnections. Accordingly, with these few interconnection locations, the potential for the operation of the handle 10 to "gum up" is relatively small. Further, it should be noted that installation of the handle 10 with the register 12 does not include any specialized or other tools.

It will be apparent to those skilled in the pertinent art that other embodiments of an air register handle in accordance with the invention can be designed. Modifications and other variations of the illustrative embodiment of the invention may be effected without departing from the spirit and scope of the novel concepts of the invention.

The embodiments of the invention in which an exclusive property or privilege is claimed are defined as follows:

1. An air register handle adapted to be mounted in air register means for regulation of air flow through said air register means into a spatial environment, said air register means comprising:

a frontal face through which air flows into or from said spatial environment;

slot means located in and extending through said frontal face and adapted to received said air register handle so that a portion of said handle protrudes forwardly of said frontal face; and adjustable means mounted rearwardly of said frontal face so that movement of said adjustable means regulates volume and/or direction of air flow through said frontal face;

characterized in that said air register handle comprises:

a first portion adapted to extend through said slot means;

bracket means connected to said first portion and adapted to protrude forwardly of said frontal face for providing means for a user to manually grasp and operate said air register handle;

tab means interconnected with said first portion and having a planar configuration skewed relative to the planar configuration of said first portion for preventing any substantial movement of said handle forwardly toward said frontal face when said handle is mounted in said air register means, said tab means comprising the only elements of said air register handle preventing any substantial forward movement; and coupling means connected to said first portion and coupled to said adjustable means for exerting forces on said adjustable means in response to manual forces exerted on said bracket means by said user when said handle is mounted in said air register means.

2. An air register handle in accordance with claim 1 characterized in that said coupling means comprises a slot opening toward an end opposing an end of said first portion to which said bracket means is connected.

3. An air register handle in accordance with claim 2 characterized in that said slot is of an arcuate shape.

4. An air register handle is accordance with claim 2 characterized in that said slot curves upwardly from said slot opening toward said first portion.

5. An air register handle in accordance with claim 2 characterized in that said slot is formed by a pair of rearwardly extending and substantially coplanar arms having a fork-shaped configuration.

6. An air register handle in accordance with claim 2 characterized in that said adjustable means of said air register means comprises interconnection means for interconnecting said adjustable means to said coupling means when said handle is mounted in said air register means, and said slot is adapted to receive said interconnection means so that said interconnection means moves along a path of said slot in response to manual forces exerted on said bracket means by said user.

7. An air register handle in accordance with claim 6 characterized in that said interconnection means comprises a pintle engaging said slot when said handle is mounted in said air register means.

8. An air register handle in accordance with claim 2 characterized in that said adjustable means of said air register means comprises:

louver means positioned rearwardly of said frontal face and adjustable so as to regulate air flow through said frontal face;

connecting means interconnecting individual ones of said louver means so as to provide operation of said individual ones of said louver means in unison;

pintle means coupled to said connecting means; and said slot is adapted to received said pintle means when said handle is mounted in said air register means.

9. An air register handle in accordance with claim 1 characterized in that said tab means comprises a pair of coplanar tabs having a resiliency sufficient so as to allow said tab pair to bend toward the plane of said first portion when forces are exerted on said handle so as to cause said handle to be moved through said slot means when said handle is installed in said air register means.

10. An air register handle in accordance with claim 1 characterized in that said tab means comprises at least one tab adapted to abut a surface of said air register means so as to provide a frictional engagement therewith.

11. An air register handle in accordance with claim 1 characterized in that said tab means comprises a first resilient tab positioned adjacent a first edge of said first portion and a second resilient tab substantially coplanar with said first tab and positioned adjacent a second edge of said first portion, where said second edge is substantially parallel to said first edge.

12. An air register handle in accordance with claim 1 characterized in that:

said slot means comprises a vertically disposed and elongated slot located at one side of said frontal face; and said bracket means comprises a bracket integral with said first portion and having a size sufficient so as to prevent said handle from being pushed rearwardly of said frontal face when said handle is mounted in said air register means.

13. An air register handle in accordance with claim 1 characterized in that:

said first portion comprises a straight flat portion adapted to extend through said slot means; and said coupling means comprises an arcuate flat portion coplanar and integral with said first portion.

14. An air register handle in accordance with claim 13 characterized in that said arcuate flat portion is of a fork-shaped configuration having a pair of substantially parallel and arcuate arms forming a slot at an end of said handle.

15. An air register handle adapted to be mounted in air register means for regulation of air flow through said air register means into a spatial environment, said air register means comprising:

a frontal face through which air flows into or from said spatial environment;

slot means located in and extending through said frontal face and adapted to receive said air register handle so that a portion of said handle protrudes forwardly of said frontal face; and adjustable means mounted rearwardly of said frontal face so that movement of said adjustable means regulates volume and/or direction of air flow through said frontal face;

characterized in that said air register handle comprises;

a first portion adapted to extend through said slot means;

bracket means connected to said first portion and adapted to protrude forwardly of said frontal face for providing means for a user to manually grasp and operate said air register handle; and handle slot means integral with and located rearwardly of said first portion, and comprising an arcuate flat portion having a fork-shaped configuration with a pair of substantially parallel and arcuate arms forming a slot opening toward an end opposing an end of said first portion to which said bracket means is connected.

16. An air register handle in accordance with claim 15 characterized in that said handle further comprises tab means interconnected with said first portion and having a planar configuration skewed relative to the planar configuration of said first portion for preventing any substantial movement of said handle forwardly toward said frontal face when said handle is mounted in said air register means.

17. An air register handle adapted to be mounted in air register means for regulation of air flow, said air register handle comprising:

a forward bracket;

a substantially flat and straight portion extending rearwardly from said bracket and integral therewith;

an arcuate flat portion integral with said straight portion and having a fork-shaped configuration, whereby two substantially parallel and arcuate arms form an open slot at an end of said handle opposing an end of said straight portion to which said bracket is integrally connected; and a pair of handle tabs connected to and extending above and below said straight portion, wherein said tabs are coplanar and positioned at an acute angle of less than 90° relative to a plane of said straight portion.

18. An air register and handle arrangement for regulation of air flow into or from a spatial environment, said arrangement comprising:

a frontal face adapted to be mounted to a wall, floor or ceiling, and through which air flows into or from said spatial environment;

slot means located in and extending through said frontal face for receiving an air register handle of said arrangement;

adjustable means mounted rearwardly of said frontal face so that movement of said adjustable means regulates air flow through said face;

handle bracket means located forwardly of said face in said spatial environment for allowing a user to manually adjust said adjustment means;

a first portion connected to said handle bracket means and extending through said slot means;

tab means interconnected with said first portion for preventing substantial movement of said first portion toward said said frontal face, and comprising a pair of coplanar tabs having a resiliency sufficient so as to allow said tab pair to bend toward the plane of said first portion when said first portion is positioned in front of said frontal face and forces are exerted on said handle bracket means so as to cause said first portion to move through said slot means from the front of said frontal face to the rear of said frontal face; and coupling means connected to said first portion and coupled to said adjustable means for exerting forces on said adjustable means in response to manual forces exerted on said handle bracket means by said user.

19. An air register arrangement in accordance with claim 18 characterized in that:

said slot means comprises a vertically disposed and elongated slot extending through said frontal face along one side thereof;

said adjustable means comprises a plurality of substantially parallel louver-type elements, each of said elements having at least one end thereof pivotably engaged to a frame of said arrangement, and further having one end thereof pivotably engaged to a connecting link; and said coupling means comprises an arcuate slot opening rearwardly of said frontal face and movably engaging a pintle-type element coupled to said connecting link.

* * * * *